US005190375A

United States Patent [19]

Shiobara

[11] Patent Number: 5,190,375

[45] Date of Patent: Mar. 2, 1993

[54] AGITATOR WITH A ROTARY SHAFT AND HOLLOW SHAFT FOR STIRRING AND MIXING MATERIALS

[75] Inventor: Katsumi Shiobara, Yono, Japan

[73] Assignee: Satake Chemical Equipment Mfg., Ltd., Moriguchi, Japan

[21] Appl. No.: 568,721

[22] Filed: Aug. 17, 1990

[30] Foreign Application Priority Data

Aug. 21, 1989 [JP] Japan ..... 1-96753
Apr. 17, 1990 [JP] Japan ..... 2-40274

[51] Int. Cl.[5] ..... B01F 7/16

[52] U.S. Cl. ..... 366/294; 366/295; 366/296; 366/331; 310/83

[58] Field of Search ..... 366/244, 251, 252, 283, 366/282, 287, 288, 293, 294, 295, 296, 292, 270, 325, 331, 197, 199, 206; 310/83, 90; 464/183; 68/23.7; 416/170 R

[56] References Cited

U.S. PATENT DOCUMENTS

| | | | |
|---|---|---|---|
| 1,563,945 | 12/1925 | Apple | 310/83 |
| 2,024,340 | 12/1935 | Craddock | 366/331 |
| 2,209,287 | 7/1940 | Simpson | 310/83 X |
| 2,441,054 | 5/1948 | Ardussi et al. | 310/83 |
| 2,499,928 | 3/1950 | Misic | 310/83 X |
| 4,057,226 | 11/1977 | de Mos et al. | 366/287 X |
| 4,403,868 | 9/1983 | Kupka | 366/295 |
| 4,676,654 | 6/1987 | Fleckner | 366/295 X |
| 4,854,720 | 8/1989 | Schold | 366/295 X |

FOREIGN PATENT DOCUMENTS

| | | | |
|---|---|---|---|
| 124236 | 10/1901 | Fed. Rep. of Germany | 366/295 |
| 2735102 | 2/1979 | Fed. Rep. of Germany | 366/293 |
| 2231420 | 12/1974 | France | 366/296 |
| 6928 | 1/1984 | Japan | 366/249 |
| 718143 | 2/1980 | U.S.S.R. | 366/295 |
| 429333 | 5/1935 | United Kingdom | 366/296 |
| 2052278 | 1/1981 | United Kingdom | 366/295 |

*Primary Examiner*—Harvey C. Hornsby
*Assistant Examiner*—Charles Cooley
*Attorney, Agent, or Firm*—Oblon, Spivak, McClelland, Maier & Neustadt

[57] ABSTRACT

An agitator which includes a rotary shaft fixedly provided at a free end thereof with a stirring rotor and an electric motor disposed in the vicinity of a head portion of the rotary shaft. A portion of the rotary shaft extending within the casing of the electric motor is extended through a hollow shaft, and the rotary shaft and the hollow shaft are journaled in bearings at upper and lower ends of the casing. The rotor of the electric motor is fixed to a middle portion of the hollow shaft, and the rotary shaft and the hollow shaft are interlocked with each other by a gear reduction mechanism. The agitator has a compact construction, facilitates maintenance work, and demonstrates excellent performance in agitating materials in a deep agitation tank or in agitating a liquid having a high viscosity.

3 Claims, 3 Drawing Sheets

AGITATOR WITH A ROTARY SHAFT AND HOLLOW SHAFT FOR STIRRING AND MIXING MATERIALS

BACKGROUND OF THE INVENTION

1. Field of the Invention

The present invention relates to an agitator for stirring and mixing materials for reaction or thorough mixing.

2. Discussion of the Background

A conventional agitator comprises, as shown in FIG. 3, a rotary shaft a fixedly provided at its lower end with a stirring rotor, a casing b journaling the rotary shaft a, a reduction gear mechanism c joined to one end $b_1$ of the casing b, and an electric motor d for driving the reduction gear mechanism c. Indicated at e are ball bearings and at f is a gland packing.

This conventional agitator is comparatively long because the reduction gear mechanism c and the electric motor d are disposed on the upper end of the rotary shaft a, and the arrangement of the bearings and the sealing members makes replacement and maintenance of the rotary shaft difficult.

Furthermore, being journaled at one end, the rotary shaft is liable to be flexed by a bending moment, and hence vibrations and noise are generated and the agitating performance of the agitator is unsatisfactory.

SUMMARY OF THE INVENTION

Accordingly, it is an object of the present invention to provide an agitator of a construction facilitating maintenance thereof.

Another object of the present invention is to provide an agitator capable of demonstrating excellent agitating performance in agitating materials in a deep agitation tank and in agitating a liquid having a high viscosity.

To achieve these objects, the present invention provides an agitator comprising a rotary shaft fixedly provided at one extremity thereof with a stirring rotor, an electric motor disposed near the other extremity of the rotary shaft, and a reduction gear mechanism provided in the casing of the electric motor, characterized in that a portion of the rotary shaft extending within the casing of the electric motor is received in a hollow shaft, the portion of the rotary shaft extending within the casing is supported at its upper and lower ends by bearings, the hollow shaft is supported at its upper and lower ends by bearings, the rotor of the electric motor is fixedly mounted on the hollow shaft in the middle portion of the hollow shaft, and the rotary shaft and the hollow shaft are interlocked with each other by the reduction gear mechanism.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
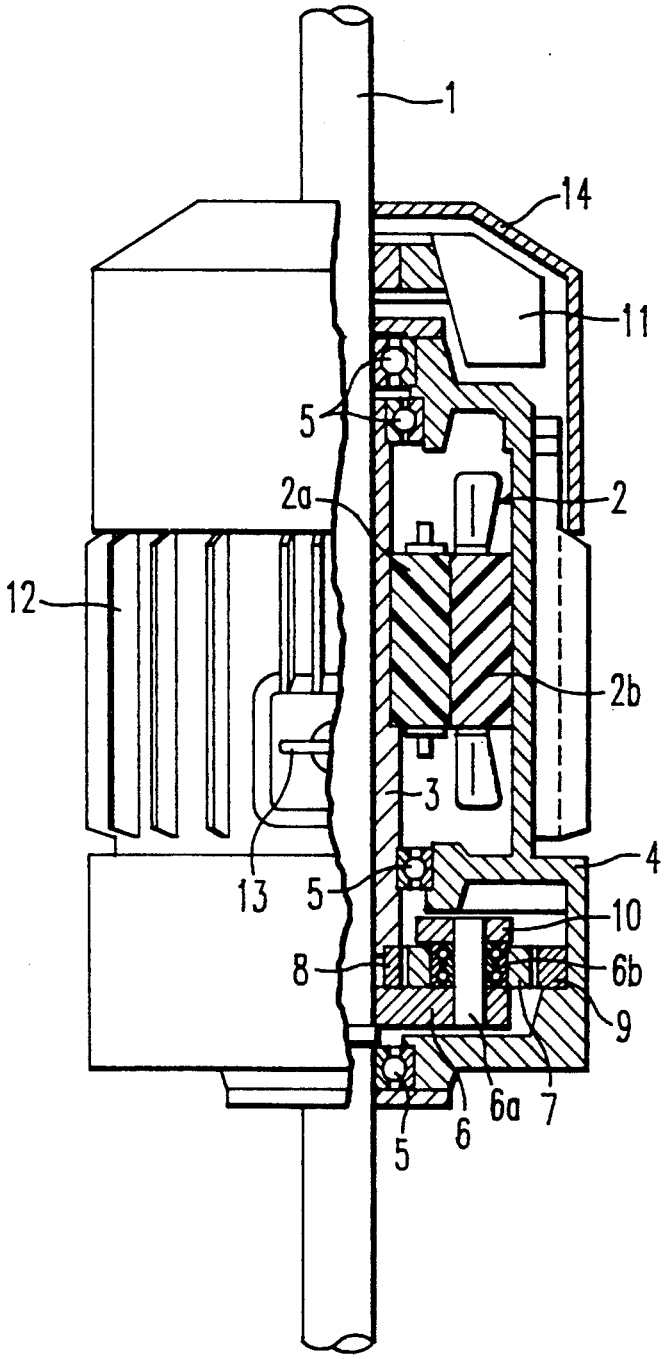
FIG. 1 is a longitudinal half-sectional view of an agitator in a first embodiment according to the present invention.

Shown in FIG. 1 is a first embodiment of the invention which includes a rotary shaft 1 fixedly provided with a stirring rotor, not shown, at its extremity, an electric motor 2, a hollow shaft 3, and a casing 4 of the electric motor 2. A rotor 2a of the electric motor 2 is fixed to the middle portion of the hollow shaft 3, and a stator 2b of the same is fixed to the casing 4.

The rotary shaft 1 and the hollow shaft 3 are journaled in bearings 5 on the casing 4 with a small gap being formed therebetween. A first set of bearings 5 are disposed above the rotor 2a and a second set of bearings 5 are disposed below the rotor 2a to hold the rotary shaft stably against a bending moment that acts on the rotary shaft 1 when the rotary shaft 1 is rotated for agitation.

A rotary member 6 for supporting a planet pinion 7 is splined to the rotary shaft 1. The planet pinion 7 is supported on a bearing 6b attached to a support shaft 6a attached upright to the rotary member 6.

Also shown in FIG. 1 are an inner gear 8 formed integrally with the hollow shaft 3 at the lower end of the same, an outer gear 9 fixed to the casing 4, a retaining plate 10 for retaining the planet pinion 7 in place, a cooling fan wheel 11, cooling fins 12, input terminals 13 of the electric motor 2, and a safety cover 14.

In operation, power is supplied through the input terminals 13 to the electric motor 2 to rotate the rotor 2a together with the hollow shaft 3 and the inner gear 8 fixed to the hollow shaft 3 by a revolving magnetic field created by the stator 2b of the electric motor 2. Consequently, the planet pinion 7 engaging both the inner gear 8 and the fixed outer gear 9 revolves around the hollow shaft 3, so that the rotary member 6 rotates at a reduced rotational speed which is lower than the rotational speed of the hollow shaft 3, whereby the rotary shaft 1, splined to the rotating member 6, is rotated.

Thus, the rotary shaft 1 rotates smoothly within the hollow shaft 3 and the stirring rotor fixed to the extremity of the rotary shaft 1 rotates. The agitator can thus be constructed so as to have a very compact and simple construction, and the rotary shaft 1, being rotatably extended through the hollow shaft 3, can easily be removed from the casing 4.

The planetary gear employed as a reduction gear in this embodiment may be substituted by any suitable speed change gear, such as a variable-speed friction speed change gear or a gear train.

The rotary shaft 1 in this embodiment is projected upward from the safety cover 14. The upper end of the rotary shaft 1 need not necessarily be projected upward from the safety cover 14 and may be contained within the safety cover 14.

Figure 2:
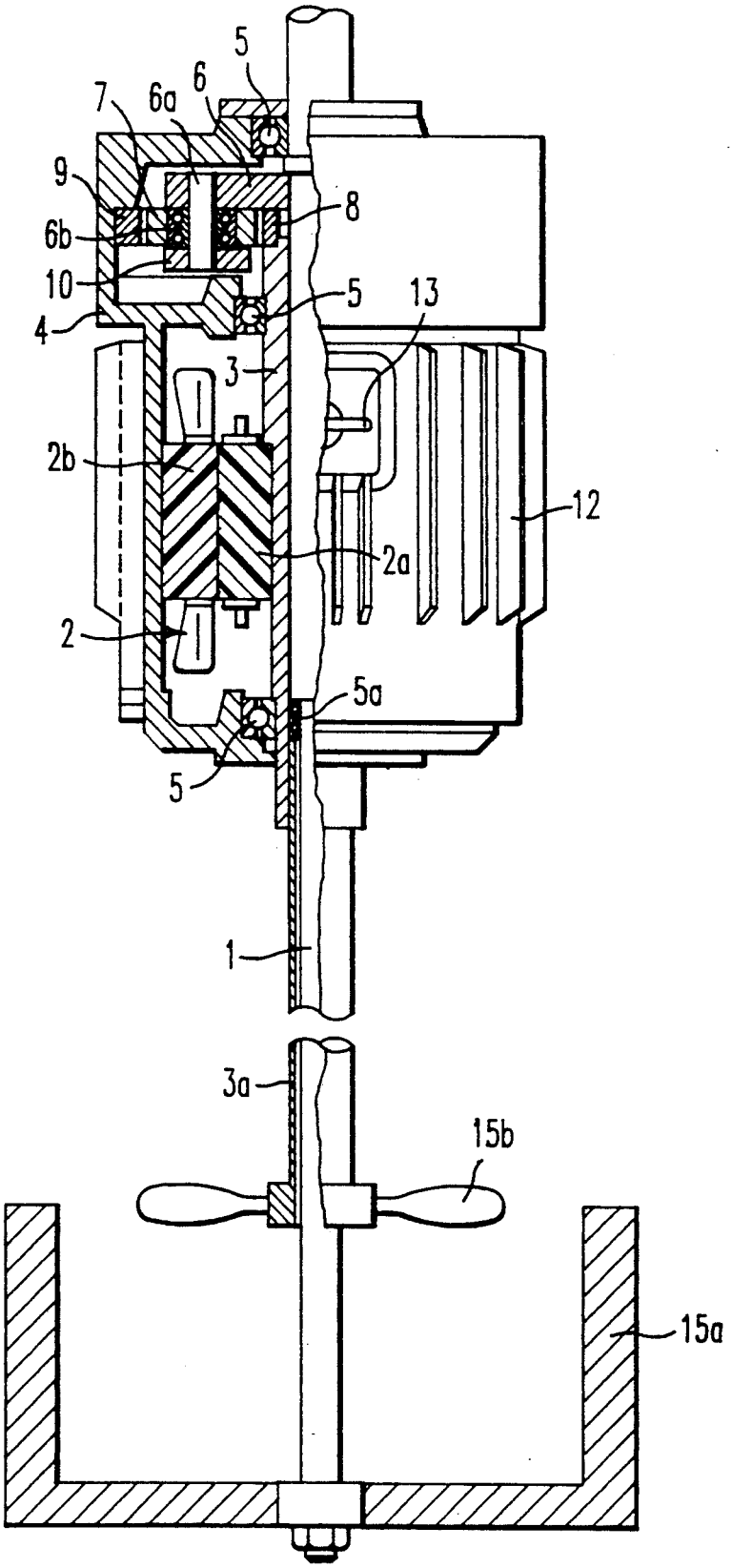
FIG. 2 is a longitudinal half-sectional view of an agitator in a second embodiment according to the present invention.
Figure 3:
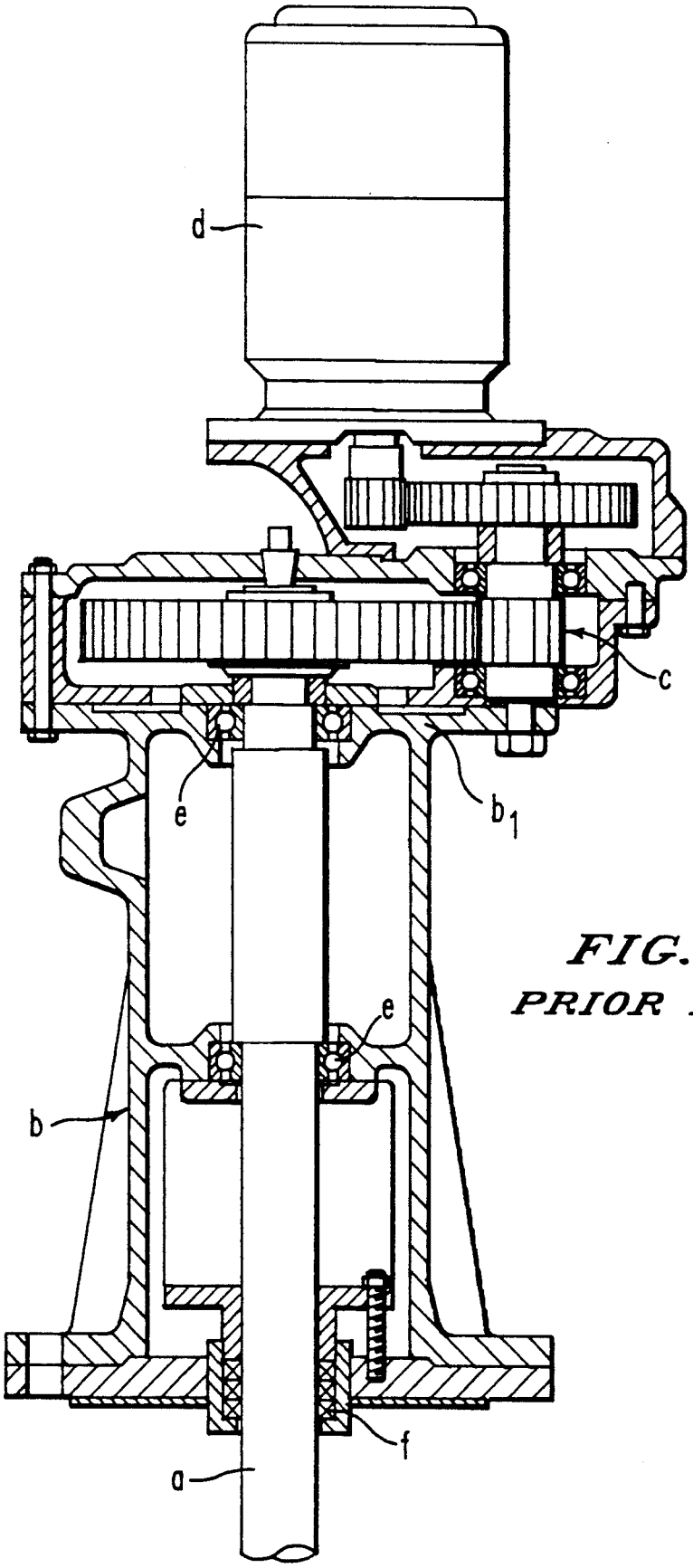
FIG. 3 PRIOR ART
FIG. 3 is a longitudinal partly sectional view of a conventional prior art agitator.

An agitator of a second embodiment according to the present invention shown in FIG. 2 is similar in construction to the agitator in the first embodiment shown in FIG. 1, and hence parts like or corresponding to those of the agitator shown in FIG. 1 are denoted by the same reference characters and a description thereof will be omitted.

As shown in FIG. 2, the rotary shaft 1 is fixedly provided at its lower end with a first stirring rotor 15a having stirring blades each having a shape resembling the letter L, and with a second hollow shaft 3a extended from the lower end of a first hollow shaft 3 and fixedly provided at its lower end with a second stirring rotor 15*b*, which is an ordinary stirring rotor having a diameter smaller than that of the first stirring rotor 15*a*. A planetary gear is disposed in the upper portion of the interior of the casing 4. The rotary shaft 1 is supported in a bearing 5*a* on the first hollow shaft 3 at a part corresponding to the lower end of the first hollow shaft 3.

When power is supplied through, terminals 13 to the electric motor 2, the rotary shaft 1 which extends through the first hollow shaft 3 with a small gap therebetween is rotated smoothly. The first stirring rotor 15*a* fixed to the lower end of the rotary shaft 1 rotates at a comparatively low rotational speed, while the second stirring rotor 15*b* fixed to the lower end of the second hollow shaft 3*b* rotates at a comparatively high rotational speed in a rotational direction reverse that of the first stirring rotor 15*a*. Thus, the agitator is constructed so as to be of a compact, simple construction. Since the rotary shaft 1 is rotatably received in the first hollow shaft 3, the rotary shaft may be comparatively long. The respective opposite directions of rotation of the rotary shaft 1 and the first hollow shaft 3 enhances the stirring performance of the agitator.

The agitator of the present invention may be provided with any suitable stirring rotor, such as a cage type stirring rotor.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An agitator, which comprises:

a first and second hollow shaft which are coaxial, said second shaft extending from a distal end of said first shaft;

a rotary shaft positioned within said first and second hollow shafts;

a first and a second stirring rotor which are coaxial and are positioned at a distal end of said rotary shaft and said second hollow shaft, respectively;

an electric motor disposed at an end portion of the rotary shaft, said motor having a casing, a rotor and a stator wherein said motor drives the first hollow shaft;

a gear reduction mechanism which includes a rotary member, said gear reduction mechanism being driven by said first hollow shaft and being positioned in said casing for engaging said rotary shaft, wherein a portion of the rotary shaft extends within the casing and is rotatably received in said first hollow shaft and wherein said gear reduction mechanism includes means for rotating said rotary member at a speed which is lower than that of the first hollow shaft; and bearing members for journaling the rotary shaft at upper and lower ends of the casing, wherein the rotor of the electric motor is fixed to a middle portion of the first hollow shaft, and the rotary shaft and the first hollow shaft are interlocked with each other by said gear reduction mechanism.

2. An agitator according to claim 1, wherein the first stirring rotor comprises a plurality of stirring blades each having a shape resembling the letter L.

3. An agitator according to claim 2, wherein the gear reduction mechanism comprises means for respectively rotating said first stirring rotor and said second stirring rotor in opposite directions and wherein the stator is fixed to the casing.

* * * * *